United States Patent [19]

Pischinger et al.

[11] Patent Number: 4,730,455

[45] Date of Patent: Mar. 15, 1988

[54] PROCESS AND SYSTEM FOR THE REGENERATION OF PARTICULATE FILTER TRAPS

[75] Inventors: Franz Pischinger, Aachen; Gerhard Lepperhoff, Eschweiler, both of Fed. Rep. of Germany

[73] Assignee: FEV Motorentechnik GmbH & Co. KG, Aachen, Fed. Rep. of Germany

[21] Appl. No.: 26,025

[22] Filed: Mar. 16, 1987

[30] Foreign Application Priority Data

Mar. 17, 1986 [DE] Fed. Rep. of Germany ..... 3608838

[51] Int. Cl.[4] ..... F01N 3/02

[52] U.S. Cl. ..... 60/274; 60/288; 60/295; 60/303; 55/283; 55/466; 55/DIG. 30

[58] Field of Search ..... 60/274, 286, 288, 295, 60/303, 311; 55/282, 283, 466, DIG. 30

[56] References Cited

U.S. PATENT DOCUMENTS 3,988,890 11/1976 Abthoff ..... 60/288
4,299,600 11/1981 Kobashi .
4,345,431 8/1982 Suzuki ..... 60/303
4,481,767 11/1984 Stark .
4,535,588 8/1985 Sato ..... 60/288

*Primary Examiner*—Douglas Hart
*Attorney, Agent, or Firm*—Watson, Cole, Grindle & Watson

[57] ABSTRACT

A process and system for the regeneration of at least a pair of side-by-side particulate filter traps for purifying the exhaust gas of an internal combustion engine, particularly a motor vehicle diesel engine, by oxidation of particulates collected in the traps, combustion of the particulates being carried out during engine operation by fuel burners respectively associated with the traps, in which a flame jet at high velocity flow is directed from one of the burners for a short duration transversely to the inflow direction of the exhaust gas to be purified directly into an associated trap without mixing with the exhaust gas flow, such that the exhaust gas in the vicinity of the one burner is diverted by the one flame jet to flow into and through the other trap while the one flame jet initiates combustion of the particulates collected in its associated trap.

11 Claims, 3 Drawing Figures

PROCESS AND SYSTEM FOR THE REGENERATION OF PARTICULATE FILTER TRAPS

BACKGROUND OF THE INVENTION

This invention relates generally to a process and system for the regeneration of particulate filter traps employed for purifying the exhaust gas of an internal combustion engine, particularly a motor vehicle diesel engine, by oxidation of particulates collected in the traps, combustion of the particulates being initiated by a fuel burner during engine operation.

An exhaust gas treatment system of some type is employed for the reduction of particle emissions from diesel engines. Such systems basically include particulate filter traps which trap and collect the solid portions in the particle phase. The deposited particulates may, however, effect an increase in the flow resistance within the exhaust gas system. This may lead to the creation of increased exhaust gas counterpressures which, depending on the torque and engine rpms, can cause an increase in fuel consumption and, in extreme cases, can lead to engine stall. It therefore becomes necessary to continually or intermittently remove the particulates deposited in the filter trap.

Oxidation of the particulates collected in the filter trap commences at temperatures above 500° to 550° C. By utilizing special catalytic coatings, soot oxidation can be carried out 400° to 450° C. Such high temperatures, however, are achieved by diesel engines only in the upper load range. Effective regeneration of the filter trap is therefore not assured during engine operation.

U.S. Pat. No. 4,481,767 discloses an exhaust gas cleaner and burner system for use with a diesel engine that utilizes a rotatable flame sweep distributor to sequentially direct the flame from a fuel burner across a full inlet face of a filter. Portions of the filter are not intermittently regenerated, but rather only that portion of the filter to be regenerated is intermittently acted upon by the flame for completely burning the soot. The flame jet is thus directed at the inlet face of the filter by a guide mechanism.

U.S. Pat. No. 4,299,600 discloses a trapper device for collecting and incinerating particulates included in the exhaust gas from a diesel engine. Filter traps are located in a pair of transversely separated chambers of the filter unit, and a valve plate is moved for alternately opening either filter trap for receiving the exhaust gas while the other filter trap is closed. The valve plate has a pair of fuel injection nozzles each of which is adapted for communicating a common fuel inlet with one of the traps which is closed by the valve plate.

In both these prior art system no intermittent igniting of the deposited particulates takes place, and in both systems moving parts are required such as guide mechanisms and valve plates for the combustible fuel, and the flames cannnot impinge directly on the deposited particulates for igniting the deposit.

SUMMARY OF THE INVENTION

It is therefore an object of the present invention to provide a process and system for the regeneration of particulate filter traps used for collecting particulates included in the exhaust gas from a diesel engine, in which the initiation of oxidation of the particulates is carried out in a simple and highly effective manner by supplying secondary energy, without moving parts, in the exhaust gas flow.

In accordance with the invention, fuel burners are associated with a pair of side-by-side particulate filter traps, and a flame jet of high flow velocity is directed for a short duration from one of the burners, transversely to the inflow direction of the exhaust gas to be purified, for regeneration of its associated trap by direct impingement against the particulates collected in that trap without mixing with the exhaust gas inflow. The flame jet initiates combustion of the particulates collected in the trap and simultaneously diverts the exhaust gas in the vicinity of the one burner to flow through the other trap. For regeneration of the other trap, a flame jet is directed from the other burner at high flow velocity for a short duration, transversely to the direction of exhaust gas, for direct impingement against the particulates collected in the other trap. The flame jet of the other burner initiates combustion of the collected particulates in the other trap and simultaneously diverts the exhaust gas in the vicinity of the other burner to flow through the one trap.

Compared to the prior art systems in which a clogged filter trap is closed off by a moving valve plate to the exhaust gas flow for incinerating the collected particulates in the clogged filter, in the present invention the exhaust gas is diverted through the adjoining filter from the inlet face by a flame jet at high flow velocity set transversely to the main direction of exhaust gas flow so that a mixing of the exhaust gas and flame jet is completely avoided.

The nozzle opening for the burner through which the flame emanates is set at such distance from the inlet face of the filter that the flame does not mix with the engine exhaust gas, rather the flame jet drives the engine exhaust gas to areas of the filter assembly to be regenerated following regeneration by the flame jet. In such manner, regeneration is effective by the flame jet which ignites the particulates as the temperature increases and as the soot reacts with the flame radicals which lowers the activation energy for soot combustion. As the burner flame does not mix with the exhaust gas mass flow from the engine because of the present arrangement, energy loss during regeneration is minimized so that energy costs are reduced compared to conventional burner systems with heat transported by the engine's exhaust gas.

The burner can be operated on diesel fuel, gas, or another type liquid fuel. The air required for support of combustion of the brief impulse-like combustion is supplied from a pressurized air tank which, for commercial vehicles, is charged intermittently by the compressor system for the vehicle's brakes.

Reference is made to the claims for other advantageous features of the invention.

DETAILED DESCRIPTION OF THE INVENTION

Figures 1, 2:
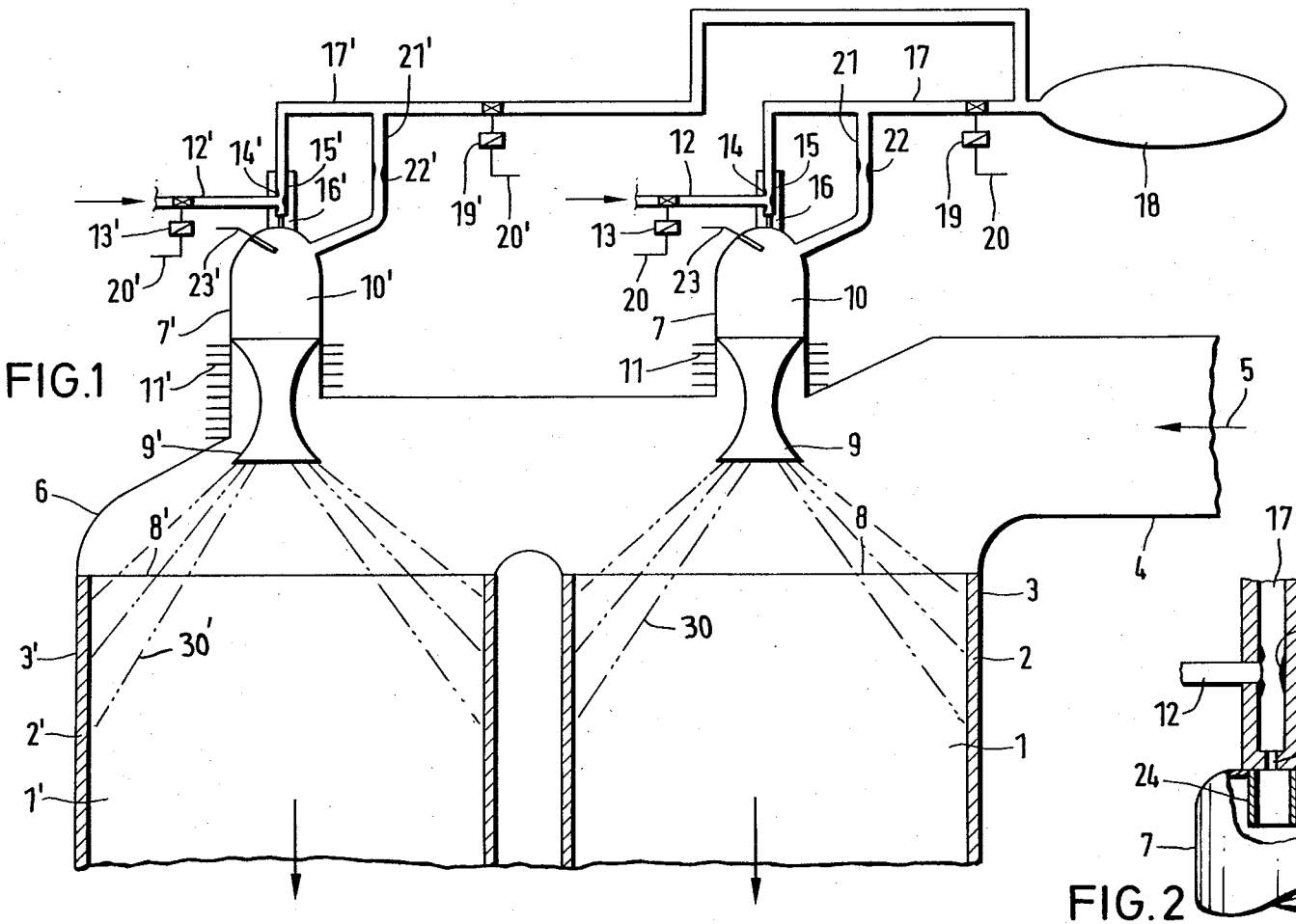
FIG. 1 is a schematic illustration of the system and process of the invention.
FIG. 2 is a schematic illustration of a portion of the combustion chamber of the burner of FIG. 1.
Figure 3:
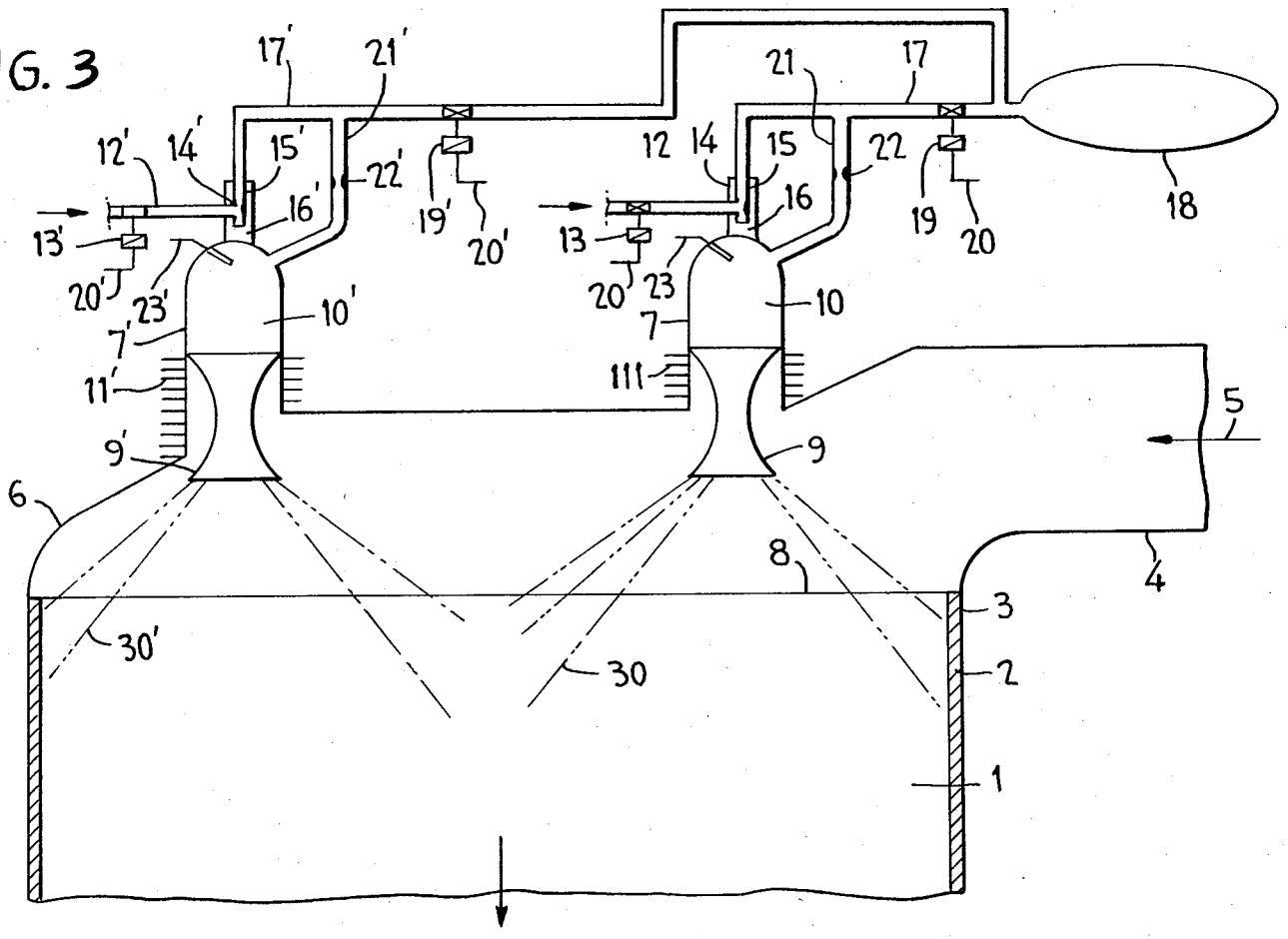
FIG. 3 is a schematic illustration of the system and process of another embodiment of the invention.

Turning now to the drawings wherein like reference characters refer to like and corresponding parts throughout the several views, a pair of transversely arranged particulate filter traps 1, 1' are generally shown in FIG. 1 as having walls 2, 2' surrounded by sheet metal shells 3, 3' connected with an exhaust pipe 4 of an internal combustion engine (not shown). The exhaust gas to be purified flows int he direction of arrow 5 to filters 1, 1'.

Burners 7, 7' are mounted in a housing 6 which covers the inlet face 8, 8' of the traps, exhaust pipe 4 transversely extending from the housing as shown. The burners extend in an axial direction of the filter traps with which they are associated such that flame jets 30, 30', upon selective actuation of the burners, are directed at front surfaces 8, 8' of the filters. The burners include discharge nozzles 9, 9' and combustion chambers 10, 10' upstream of the nozzles. In order to reduce the conduction of heat and thus to reduce the heating up of the combustion chambers during operation of the engine in the upper load range, cooling ribs 11, 11' surround the connections between the combustion chambers and the housing, and between chamber 10 and the exhaust pipe for burner 7. The heat supply from the exhaust gas is thereby reduced by conducting the heat to the combustion chambers such that carbonization hazards can be minimized when the burners are idle.

Fuel inlet lines 12, 12' are provided for the burners, the lines having fuel valves 13, 13', air-fuel injectors 14, 14' and burner jets 15, 15' for atomizers 16, 16'. Air inlet lines 17, 17' branch into the fuel lines, and air for supporting combustion is fed from a pressurized air tank 18 which, for example may be charged by the vehicle's brake compressor (not shown).

Air lines 17, 17' are provided with air control valves 19, 19', and fuel lines 12, 12' are similarly provided with fuel control valves 13, 13'. Control means for operating the fuel and air valves are schematically illustrated at 20, 20'.

Auxiliary air feed lines 21, 21' branch from air lines 178, 17' directly into side walls of combustion chambers 10, 10' for tangentially feeding air into the chambers. The amount of air flowing through the auxiliary air lines may be regulated by throttles 22, 22' mounted within these lines.

When, for example, filter 1 is to be regenerated, air and fuel valves 13 and 19 are opened by controls 20. The air for supporting combustion flows from tank 18 through line 17 to injector 14 and burner jet 15 as well as to auxiliary air line 21, and the amount of air flowing through the auxiliary line may be regulated by throttle 22. The auxiliary air through line 21 enters combustion chamber 10 tangentially for effecting improved mixing with the fuel and burn-out in the chambers.

The fuel, for example from a pre-booster pump (not shown), is fed at a sufficiently high pressure to fuel line 12, and flows to injector 14. The internal mixing of fuel and air takes place in injector 14, and the fuel-air mixture atomizes at the nozzle-like atomizers 16 into combustion chamber 10. The fuel-air mixture is ignited by igniter 23 which may be in the form of a high-voltage spark igniter, an ignition tube or an ignition stick made of ceramic material.

Flame jet 30 which emerges from the nozzle 9 of burner 7 at high velocity flow is diverted straight at filter 1. The flow volume of the exhaust gas in this area is displaced by flame jet 30 and caused to flow through filter 1'. The flame jet is directed for a short duration by operation of controls 20 which close valve 13 and 19. For the regeneration of filger 1', burner 7' is ignited in the same manner as described with reference to burner 7, such that flame jet 30' emerging from the nozzle of burner 7' drives out the exhaust gas volume flow in this area and causes the exhaust gas to flow only through filter 1, in the same manner as described with reference to burner 7. The combustion intervals of the respective burners are short relative to the time for completing filter regeneration, so that flame jets 30, 30' alternately and intermittently push away the exhaust gases in the areas of their nozzles and initiate regeneration.

The burner and filter arrangement aforedescribed is not restricted to two filter systems. And, the filters need not be in the form of filter monoliths. Rather, the various regeneration areas can be regenerated through an arrangment of burners whose flame jets impinge against different surface areas of the filter.

Combustion chamber 10 is partially shown in FIG. 2 as having a connected air supply 17, fuel feed line 12, injector 14, and an atomizer nozzle 16. Ignition of the fuel/air mixture is initiated by the provision of an electrically heated (from a source not shown) ignition tube 24 which may be of ceramic material. The ignition tube is located at the terminal end of supply line 17 such that the fuel/air mixture flows through the tube. The fuel-air mixture arrives at ignition tube 24 as it exits from atomizer nozzle 1, and is ignited securely on the wall structure of the tube by reason of its high temperature.

The invention is not limited to the construction and mode of operation of burners 7, 7', such that other suitable types of burners can be utilized without departing from the invention. And, filter traps 1, 1', for use in collecting exhaust gas particulates with intermittent or continuous particulate combustion, may comprise ceramic filters of honeycomb structure, steel wool filters, or ceramic foam filters with or without catalytic coatings.

From the foregoing, it can be seen that the filter regeneration arrangement of the invention effects a simple and highly efficient regeneration with low secondary energy requirements and without inhibiting any exhaust gas flow guidance mechanisms.

What is claimed:

1. A process for the regeneration of at least a pair of side-by-side particulate filter traps employed for purifying the exhaust gas of an internal combustion engine, particularly a motor vehicle diesel engine, by oxidationo f particulates collected in the traps, combustion of the particulates being carried out during engine operation by fuel burners respectively associated with the traps, comprising the steps of regenerating one of the traps by directing a flame jet from one of the burners at high velocity flow for a short duration, transversely to the inflow direction of the exhaust gas to be purified, directly into one of the traps associated therewith without mixing with the exhaust gas flow, diverting the exhaust gas, solely by the flame jet, to flow into the other trap from the vicinity of the one burner, and simultaneously initiating combustion by the flame jet, of the particulates collected in the one trap.

2. The process according to claim 1, including the step of intermittently impinging the flame jet of the one burner into the one trap.

3. The process according to claim 1, comprising the further steps of regenerating the other trap by shutting off the one burner and directing another flame jet from the other of the burners at high velocity flow for a short duration, transversely to the inflow direction of the exhaust gas to be purified, directly into the other filter trap associated therewith without mixing with the exhaust gas flow, diverting the exhaust gas, solely by the another flame jet, to flow into the one trap from the vicinity of the other burner, and simultaneously initiating combustion, by the other flame jet, of the particulates collected in the other trap.

4. A system for the regeneration of at least a pair of side-by-side particulate filter traps employed for purifying the exhaust gas of an internal combustion engine, particularly a motor vehicle diesel engine, by oxidation of particulates collected in the traps, comprising a housing covering an inlet end of the traps, the housing having a transverse inflow conduit for inletting exhaust gas to be purified transversely to the traps, burner means including a pair of fuel burners respectively associated with the traps for directing first and second flame jets at high velocity flow, for a short duration, from the nozzles transversely to the inflow direction of the exhaust gas and directly into the traps associated therewith, said burner means including means for selectively actuating said burners such that said first flame jet initiates combustion of the particulates collected in an associated one of the traps and simultaneously diverts the exhaust gas to flow into the other of the traps.

5. The system according to claim 4, wherein the burner means includes fuel ignition means comprising an ignition tube through which a fuel air mixture flows.

6. The system according to claim 4, wherein said burner system includes a pressurized air tank for the supply of pressurized air to the burners to support combustion.

7. The system according to claim 4, wherein the connection between said burner system and said housing is surrounded by cooling ribs to reduce the conduction of heat during the burner is at idle.

8. A process for the regeneration of one particular filter trap employed for purifying the exhaust gas of an internal combustion engine, particularly a motor vehicle diesel engine, by oxidation of particulates collected in the trap, combustion of the particulates being carried out during engine operation by at least two fuel burners, respectively associated with areas of the trap, comprising the steps of regenerating one of the trap areas by directing a flame jet from the corresponding burner at high velocity flow for a short duration, transversely to the inflow direction of the exhaust gas to be purified, directly into one of the trap areas associated therewith without mixing with the exhaust gas flow, diverting the exhaust gas, solely by the flame jet, to flow into the other trap area from the vicinity of the one burner, and simultaneously initiating combustion by the flame jet, of the particualtes collected in the corresponding trap area.

9. The process according to claim 8, including the step of intermittently impinging the flame jet of the one burner into the one trap area.

10. The process according to claim 8, comprising the further steps of regenerating the other trap area by shutting off the one burner and directing another flame jet from the other of the burners at high velocity flow for a short duration, transversely to the inflow direction of the exhaust gas to be purified, directly into the other filter trap area associated therewith without mixing with the exhaust gas flow, diverting the exhaust gas, solely by the another flame jet, to flow into the one trap area from the vicinity of the other burner, and simultaneously initiating combustion, by the other flame jet, of the particulates collected in the other trap area.

11. A system for the regeneration of one particulate filter trap employed for purifying the exhaust gas of an internal combustion engine, particularly a motor vehicle diesel engine, by oxidation of particulates collected in the trap, comprising a housing covering an inlet end of the trap, the housing having a transverse inflow conduit for inletting exhaust gas to be purified transversely to the trap, burner means including at least a pair of fuel burners respectively associated with trap areas for directing first and second flame jets at high velocity flow for a short duration, from the nozzles transversely to the inflow direction of the exhaust gas and directly into the trap areas associated therewith, said burner means including means for selectively actuating said burners such that said first flame jet initiates combustion of the particulates collected in an associated area of the trap and simultaneously diverts the exhaust gas to flow into the other area of the trap.

* * * * *